United States Patent [19]

Puccio

[11] 4,140,419

[45] Feb. 20, 1979

[54] MOLDED EXPANSION JOINT

[75] Inventor: Guy S. Puccio, Amherst, N.Y.

[73] Assignee: Acme Highway Products Corporation, Buffalo, N.Y.

[21] Appl. No.: 805,281

[22] Filed: Jun. 10, 1977

[51] Int. Cl.[2] ..... E01C 11/04

[52] U.S. Cl. ..... 404/69; 52/396

[58] Field of Search ..... 404/69, 68, 64, 65, 404/47; 52/396

[56] References Cited

U.S. PATENT DOCUMENTS

| | | | |
|---|---|---|---|
| 3,331,294 | 7/1967 | Waller | 404/66 |
| 3,570,378 | 3/1971 | Honegger | 404/69 |
| 3,690,226 | 9/1972 | Hein | 404/68 |
| 3,713,368 | 1/1973 | McDowell | 404/69 |
| 3,850,539 | 11/1974 | Bowman | 404/69 |
| 3,974,614 | 8/1976 | Strong | 404/68 X |
| 3,977,802 | 8/1976 | Galbreath | 404/69 |

*Primary Examiner*—Nile C. Byers, Jr.
*Attorney, Agent, or Firm*—Christel & Bean

[57] ABSTRACT

Two concrete slabs separated by a gap are interconnected by a molded expansion joint formed by a pair of composite marginal bodies formed of metal and elastomeric material which are disposed on opposite sides of the gap. Each marginal body includes a groove with an aperture which is open in the direction of the gap. An elastomeric sealing means is disposed to span the gap and be received through the marginal body apertures for mounting in the grooves thereof wherein each marginal body includes a metal mounting plate embedded in the elastomeric material thereof which overlies the groove associated therewith. Anchor means secure each of the marginal bodies against the slabs whereby the mounting plates therein reinforceably urge the longitudinal edges of the sealing means into a firm engagement against the slabs.

13 Claims, 7 Drawing Figures

MOLDED EXPANSION JOINT

BACKGROUND OF THE INVENTION

This invention relates generally to expansion joints of the type used in an expansion joint space or gap to protect against the intrusion of dirt, water and other debris, as for example might be encountered by expansion joints employed in roadway construction. More specifically, the present invention relates to a molded elastomeric expansion seal construction that may be employed in a joint assembly having elongated elastomeric edge members or marginal bodies installed on both sides of the gap as defined by a pair of structural members such as concrete slabs wherein a flexible elastomeric sealing means spans the gap and is connected between said marginal bodies.

One problem encountered with many available expansion joint assemblies is that the longitudinal edge portions of the seal associated therewith become dislodged from the slab members or marginal bodies associated therewith over part or all of the longitudinal lengths of the joint with the result that the seal no longer remains watertight and thus, ceases to perform one of the principal functions for which it was provided.

There have been various proposals for the design of elastomeric seals or "strip seals" as they have become known and the longitudinal edge constructions therefor which have had the objective of minimizing the possibility of failure of the joint by dislodging of the seal from the slab members. In regard to expansion seals having mounting beads along the longitudinal edges thereof for mounting in a corresponding cavity of the slab members, a number of specific problems have been encountered. It has been found very difficult in the prior art to form metal edge members, adapted for assembly in the slab members, having cavities therein of predetermined cross-sections which include any degree of high tolerance along the entire extruded length thereof. For example, in extruding a metal edge member with a cavity therein on the order of 16 feet in longitudinal length as might be utilized in a road joint, it has been found that the extrusion process fails to maintain uniformity in the cross-sectional dimensions of the cavity along the entire longitudinal length thereof. On the other hand, it has been found possible in the prior art to maintain a relatively high degree of tolerance with respect to the outer surface cross-sectional dimensions of an extruded mounting or retaining bead of an expansion seal. Necessarily, the resultant differences in uniformity between the aforesaid seal beads and associated cavities result in the possibility of the beads being more easily dislodged from such metal edge members. Applicant's U.S. Pat. No. 3,994,609, issued Nov. 30, 1976 to the assignee of the present invention, discloses a seal bead and related edge member cavity construction overcoming these problems.

However, when considering the use of a molded elastomeric edge member or marginal body for retaining the longitudinal edge of a strip seal in mounted position with a slab member in an effective manner, a number of problems have been encountered in regard to providing a watertight seal wherein the components of the joint will not dislodge from one another. Necessarily, an elastomeric edge member or marginal body unlike a metal edge member is subject to deformation which in turn can affect its effective engagement with and retention of a sealing strip. Furthermore, it is necessary that the bottom surface of such an elastomeric edge member firmly engage the underlying slab member so that water may not pass therebetween. Furthermore, it is desirable to insure that the longitudinal edges of the marginal body do not curl up or lift up vertically with respect to the slab members when assembled therewith whereby the watertightness of the construction could be jeopardized as well as its resistance to wear from traffic passing thereover.

SUMMARY OF THE INVENTION

Accordingly, one object of the present invention is to provide an expansion joint of the aforesaid type incorporating molded elastomeric edge members forming a dependable seal between a pair of spaced slabs and a strip seal spanning the gap between the slab members and which minimizes the discontinuities therebetween.

Another object of the present invention is to provide the aforesaid construction wherein the molded edge member firmly engages the underlying slab member and is positively precluded from experiencing vertical uplift with respect to the slab member with which it is engaged.

A further object of the present invention is to provide the aforesaid molded expansion joint construction wherein the elastomeric edge members thereof include a metal plate embedded therein for reinforceably retaining the longitudinal edges of a strip seal in firm engagement with underlying slab members.

Still another object of the present invention is to provide the aforesaid joint construction wherein dislodgement of the edge of a strip seal from an edge member and underlying slab member is affirmatively resisted even as or when such strip seal may experience extreme expansion across the gap defined between the slabs.

Yet still another object of the present invention is to provide an expansion joint which, upon a narrowing of the gap between adjoining roadway sections for example, tends to eject soil and rubbish previously accumulated therein.

In summary, the present invention provides an expansion joint for bridging the gap between a pair of structural slab members. The joint includes two molded, elastomeric edge members or marginal bodies formed of a composite metal and elastomeric construction. An edge member is disposed on each side of the gap to generally adjoin the upper surface of a slab member on the longitudinal edge of the gap. Each of the edge members or marginal bodies further includes a groove on the underside thereof with an aperture which opens in the direction of the gap for the reception and mounting of a longitudinal edge of a strip seal. In addition, each marginal body includes a metal mounting plate embedded in its elastomeric material which overlies the groove for affirmatively drawing the edge of the strip seal against a slab member when the edge member is anchored to such slab member. The edge member or marginal body further includes a concave bottom surface for insuring a watertight engagement with the slab member. There is a tapered interface provided between the edge portion of a strip seal and the overlying portion of the edge member aperture whereby engagement therebetween is further increased when the strip seal experiences extreme expansion. The lateral face of the edge member adjacent the gap is configured to eject debris in the gap as the slab members expand towards one another while the lateral face of the edge member non-adjacent to the gap is so configured to be encapsulated by the slab member so as to be precluded from uplift.

The foregoing and other objects, advantages and characterizing features of the present invention will become clearly apparent from the ensuing detailed description of an illustrative embodiment thereof, taken together with the accompanying drawings wherein like references denote like parts throughout the various views.

DETAILED DESCRIPTION OF AN ILLUSTRATIVE EMBODIMENT

Figure 1:
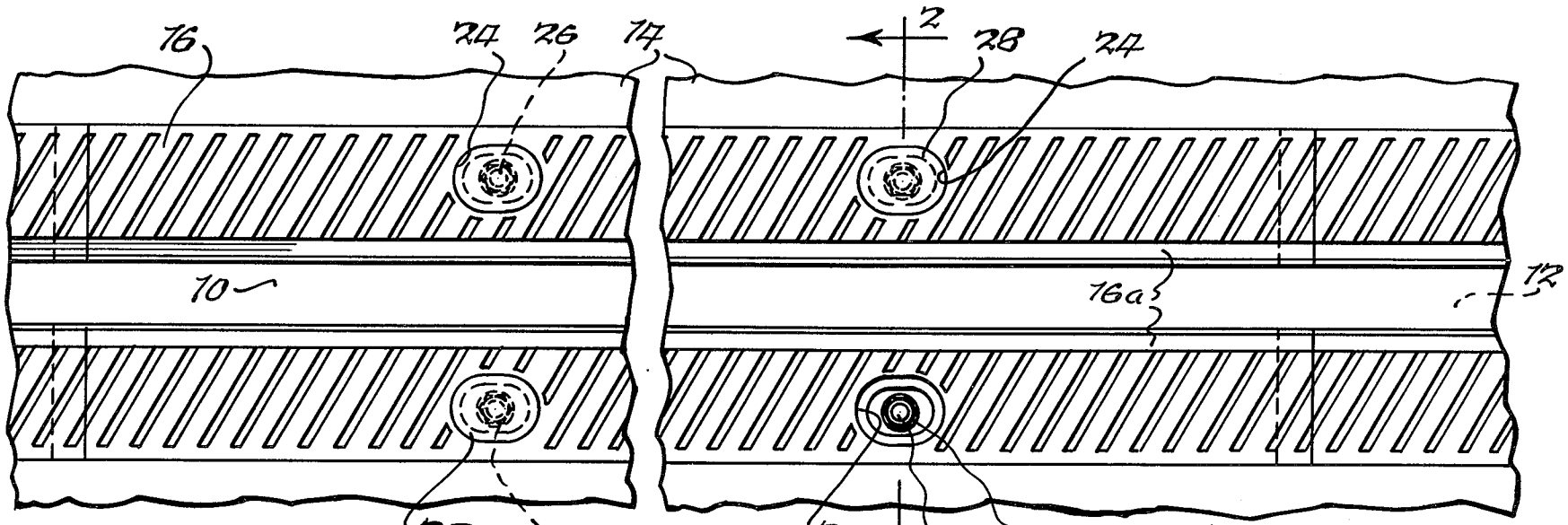
FIG. 1 is a top plan view shown in fragmentary form with portions broken away of the expansion joint forming the present invention.
Figure 2:
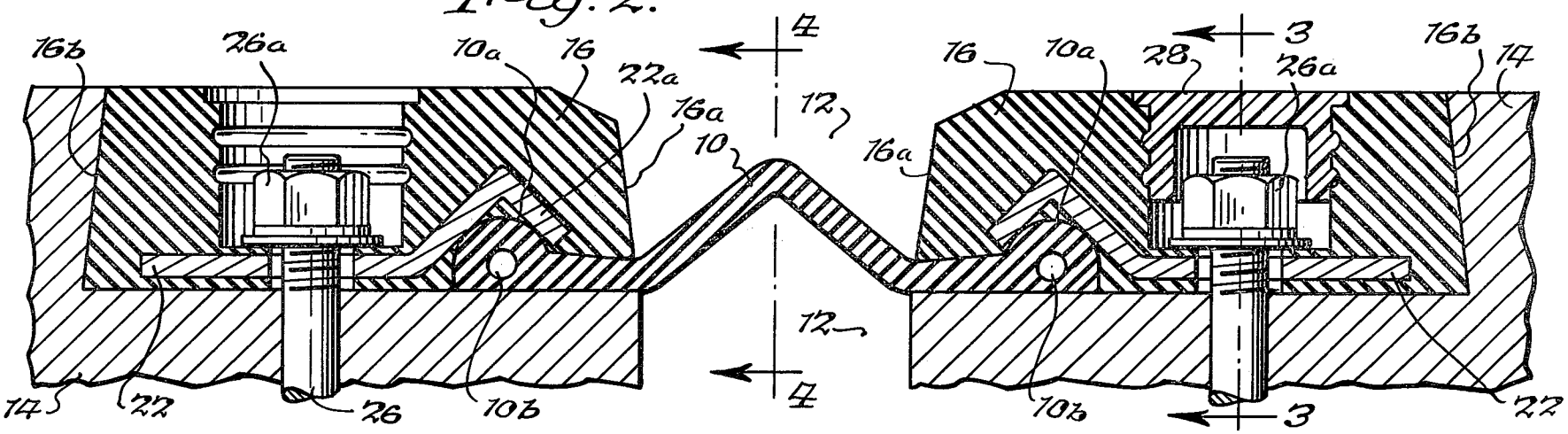
FIG. 2 is a vertical sectional view of an expansion joint, according to the invention, bridging a pair of spaced structural slab members as taken about on line 2—2 of FIG. 1.
Figure 3:
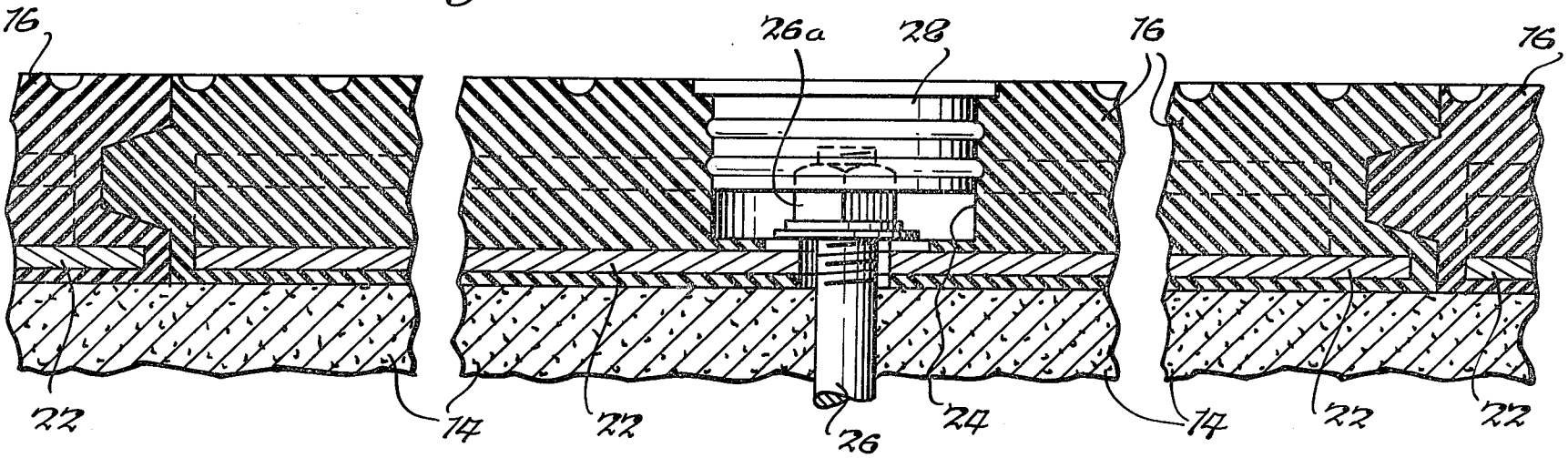
FIG. 3 is a longitudinal sectional view, in fragmentary form with portions broken away, of a molded edge member or marginal body as taken about on line 3—3 of FIG. 2.
Figure 4:
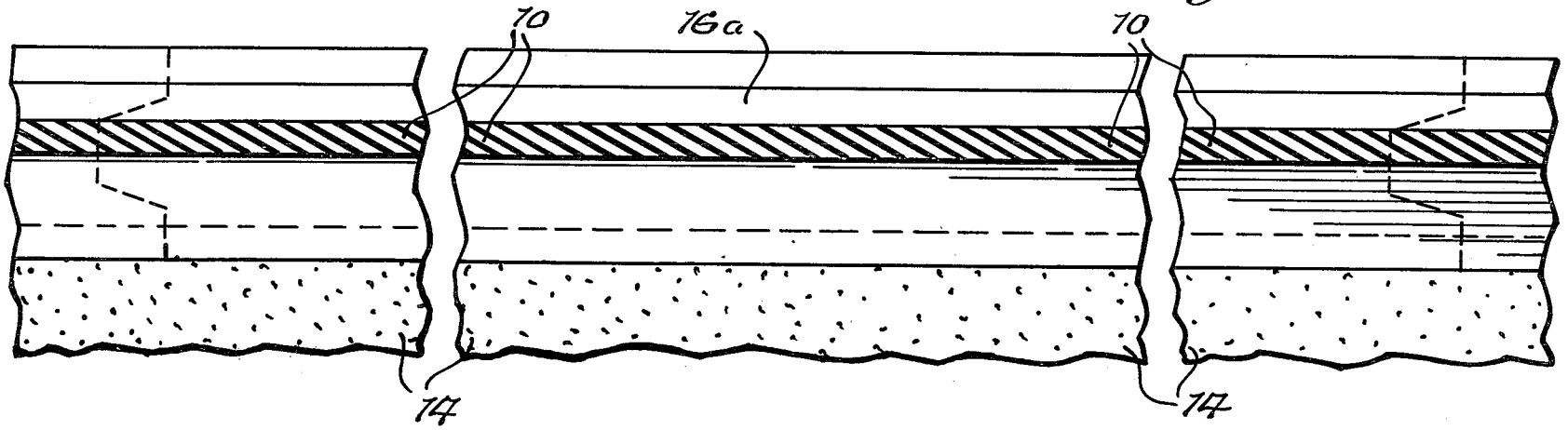
FIG. 4 is a longitudinal view in section of a strip seal spanning the gap between a pair of slab members as taken on about line 4—4 of FIG. 2.

Referring now in detail to the drawings, there is shown in FIGS. 1 and 2 an elongated, resiliently yieldable sealing strip or member 10 which spans the gap 12 between a pair of structural slab members 14 wherein the latter may comprise for example, pavement sections in a bridge construction. Sealing member 10 preferably is composed of a resiliently yieldable elastomeric material, such as neoprene for example, or any other elastomeric material having similar properties of durability, sufficient compression and expansion capabilities, high in abrasion resistance and capable of withstanding temperature extremes, sunlight, weathering, oxidation and deleterious chemicals. Sealing strip 10 is formed of a unitary one-piece construction and can be of any desired length.

A pair of spaced apart, elongated edge members or marginal bodies 16 are disposed on opposite sides of gap 12 to generally adjoin the upper surfaces of the slab members 14 and the longitudinal edges of gap 12. Each of the bodies 16 include a groove 18 with an aperture 20 which is open in the direction of gap 12 for the reception and mounting of a longitudinal edge portion of the sealing means 10. In referring to the aperture 20, it is to be understood that the aperture is actually defined between the portion of marginal body 16 adjacent gap 12 and the underlying surface of the slab member 14.

Each marginal body 16 is formed of an elastomeric material in a composite form so as to include a metal mounting plate 22 which is embedded in the elastomeric material forming the marginal body 16. As is clearly apparent from FIGS. 2 and 5, the metal plate 22 extends parallel to the base portion of the marginal body and includes a downwardly oriented V-shaped portion **22*a* which overlies groove 18**.

Figure 5:
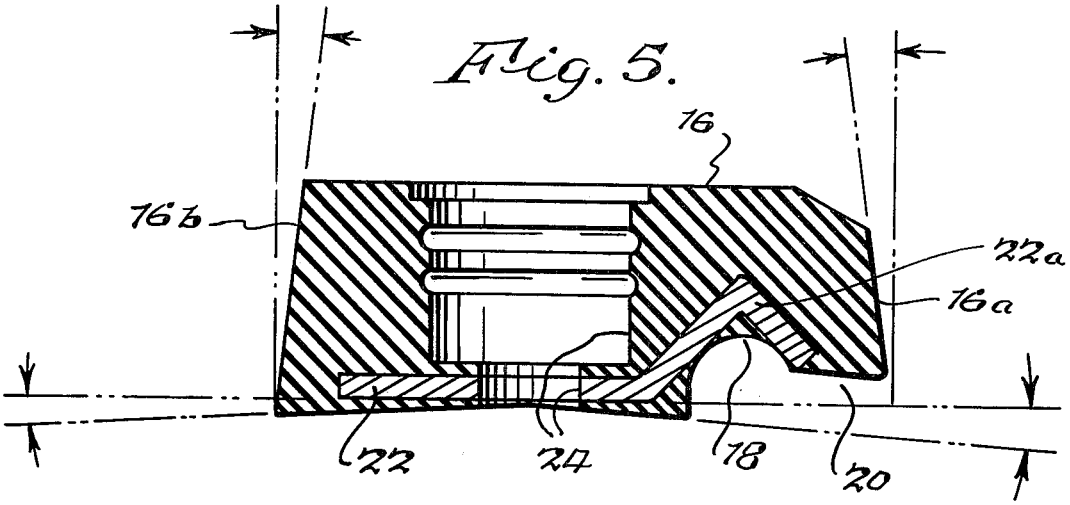
FIG. 5 is an isolated, detail view of an edge member in transverse cross-section showing the same in a disassembled condition.
Figure 6:
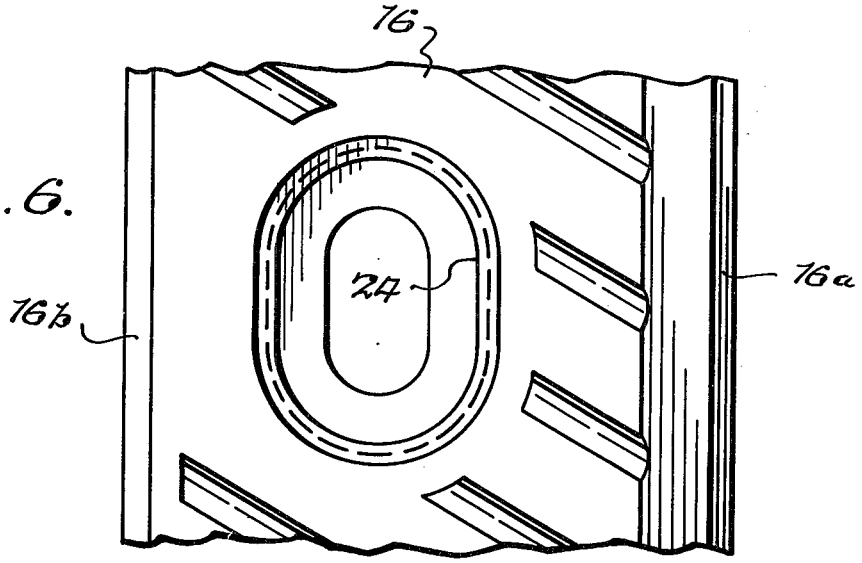
FIG. 6 is an isolated top plan view of an edge member opening through which the edge member is anchored to an underlying slab, the edge member being shown in fragmentary form.
Figure 7:
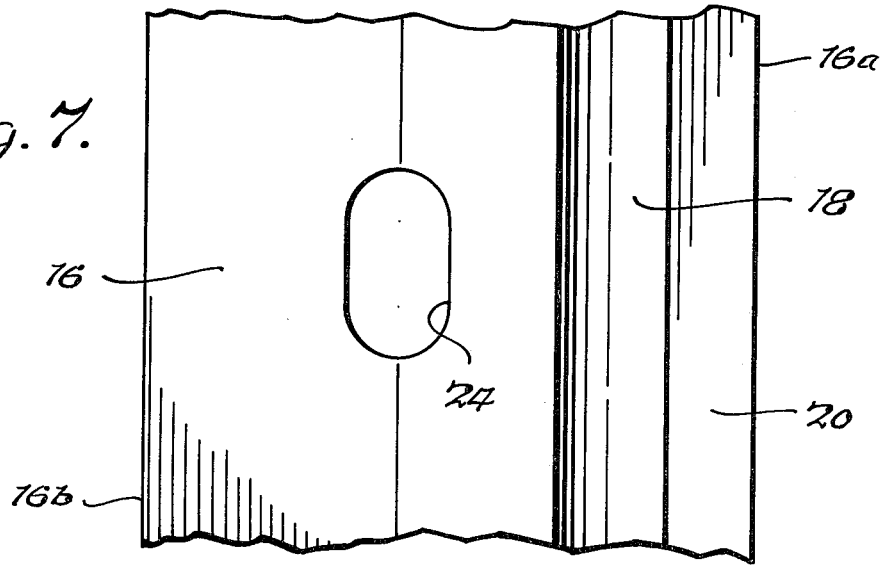
FIG. 7 is a view similar to FIG. 6 showing the underside of the edge member opening as described in FIG. 6.

As is most clearly seen in FIGS. 2 and 5, each of the marginal bodies 16 further includes an upstanding face portion **16*a* adapted to be disposed along and adjacent to a longitudinal edge of gap 12. Each face portion 16*a* is tapered upwardly away from gap 12** for purposes of ejecting debris from the gap as to be more fully discussed hereinbelow.

In a similar manner, each of the marginal bodies further includes an upstanding face portion **16*b* laterally spaced from gap 12 which is generally parallel to the longitudinal edges of the gap. Each of the face portions 16*b* is tapered towards the gap with each respective slab member being formed against the face portion 16*b***.

As is apparent from the drawings, mounting apertures 24 are provided to extend through the marginal bodies 16 at selected locations along the longitudinal length thereof. A corresponding number of anchor or bolt means 26 are affixed to the slab members so as to be received in the mounting apertures 24 of the marginal bodies. The fastening means **26*a* associated with the bolts may be engaged therewith so as to firmly draw the marginal bodies downwardly against the underlying slab members. In addition, an appropriate plug member 28 may be inserted into top of aperture 24 so as to protect the anchor means 26** from external road and weather conditions.

As is apparent from FIG. 5 of the drawings, the bottom surface of each marginal body 16 in a disassembled form is of a concave configuration in transverse cross section whereby the longitudinal edges of such bottom surface are drawn into firm engagement with an underlying slab member upon assembly with an anchor means 26 passing through the central transverse portion of body 16. It is to be further noted from FIGS. 2 and 5, that the aperture 20 as defined in part by the overlying surface of the marginal body 16 tapers downwardly in the direction extending from groove 18 towards gap 12 so as to have a tapered interface with the longitudinal edge of sealing member 10.

As is fully apparent from FIG. 2, each longitudinal edge of sealing member 10 includes a beaded configuration **10*a* including a hollow cavity 10*b* extending through the central portion thereof so as to insure a fully resilient and firm engagement with the mounting plate portion 22*a*. It is to be also noted that the portion of sealing member 10 immediately adjacent to the beaded edge 10*a* tapers downwardly in a direction extending toward gap 12 so as to present a corresponding interface with the overlying portion of the marginal body 16**.

In employing the aforesaid expansion joint construction for bridging the gap between a pair of structural slab members, a number of distinct operational advantages are provided. A primary feature resides in the composite nature of the marginal bodies 16 whereby the mounting plate provides firmness and limited rigidity thereto while insuring that the beaded edge of the sealing member 10 is firmly retained in place against an underlying slab member. Necessarily, the degree of pressure exerted by the plate portion **22*a* is determined by the degree of engagement of the anchor elements 26 and 26*a* with the body 16. In conjunction with FIG. 5, it is to be appreciated that as the marginal body 16 is drawn down against an underlying slab member, the angular orientation of the bottom surface thereof in disassembled form will tend to flatten out. Accordingly, it is considered a distinct advantage to form the bottom surface of the marginal body into a concave configuration when the same is in a disassembled condition so as to insure that the bottom longitudinal edges of body 16 are biased into a firm engagement with a slab member when assembled therewith. This is to be contrasted with potentially forming the marginal body 16** with a flat bottom surface when the same is disassembled whereby the bottom edges could curl up upon drawing the central portion of the marginal body tightly down into engagement with an underlying slab member.

As stated, a tapered interface exists between the sealing member portion immediately adjacent the beaded edge 10*a* and the overlying marginal body portion. As viewed in FIG. 2, it becomes readily apparent that should the gap 10 experience severe expansion, the corresponding expansion of sealing member 10 would tend to potentially draw the edge portion of the seal away from marginal body 16. However, it also becomes readily apparent that the degree of pressure exerted by the marginal body on the edge portion of the seal would increase should the thicker portion of the edge seal tend to move through the tapered opening referred to hereinabove. In short, the degree of retention applied to the edge of the sealing member increases when it is most needed — that being when the sealing member experiences extreme expansion.

In regard to the tapered face portions 16*a* and 16*b* of the marginal bodies, the same are provided for very specific yet different purposes. In FIG. 2, it is to be appreciated that as the slab members expand, gap 12 will narrow resulting in a compression and upward movement of the apex of sealing member 10. Should any debris have collected on top of sealing member 10, the movement thereof in conjunction with the outwardly tapered face portions 16*a* will tend to readily expel debris from gap 12. Necessarily, such expulsion action experiences an increased effectiveness directly proportionate to the degree of gap contraction.

On the other hand, the tapering of the face portion 16*b* of each marginal body towards the gap 12 allows a concrete slab for example to be poured and formed vertically above an underlying projected portion of a marginal body as is clearly shown in FIG. 2. With the marginal body being locked against lateral movement with respect to the slab by its engagement with an anchoring means, the edge or end portion of the marginal body associated with face portion 16*b* is precluded from experiencing vertical uplift with respect to the upper surface of slab 14. Necessarily, the prevention of such vertical uplift of the marginal body is an important consideration whereby severe road wear on any marginal body portion which might otherwise lift above the pavement or slab surface is avoided.

From the foregoing, it is apparent that the objects of the present invention have been fully accomplished. As a result of this invention, a molded elastomeric joint has been provided to have compositely formed marginal bodies of elastomeric material with metallic reinforcement plates embedded therein for reinforceably mounting the edges of a sealing member against an underlying slab member. A firm engagement of the marginal bodies with the slab members is insured by the central mounting of an anchoring means therethrough in conjunction with the specific configuration of the marginal bodies.

Having thus described and illustrated a preferred embodiment of the invention, it will be understood that such description and illustration is by way of example only and such modification and changes as may suggest themselves to those skilled in the art are intended to fall within the scope of the present invention as is limited only by the appended claims.

I claim:

1. An expansion joint sealing means for bridging the gap between a pair of structural slab members having generally horizontal upper surfaces, said expansion joint sealing means comprising:

a flexible sealing means spanning said gap, two composite marginal bodies of rigid and elastomeric material on opposite sides of said gap respectively disposed to generally adjoin the upper surfaces of said slab members and the longitudinal edges of said gap, each of said marginal bodies having a groove with an aperture which is open in the direction of said gap for the reception and mounting of a longitudinal edge of said flexible sealing means and each marginal body further including a rigid mounting plate embedded in said elastomeric material forming said body with at least a portion of said mounting plate overlying said groove and being so formed as to restrain said longitudinal edge of said flexible sealing means from withdrawal out of said groove and said aperture, and anchor means securing each of said marginal bodies to said slabs whereby each said mounting plate is reinforcibly drawn toward said longitudinal edge of said flexible sealing means to retain the latter in a firmly mounted disposition.

2. An expansion joint sealing means as set forth in claim 1 wherein each of said marginal bodies includes an upstanding face portion disposed along a respectively adjacent longitudinal edge of said gap, said face portions being tapered away from said gap so that incompressible materials are forced out of said gap as said slab members expand towards one another to close said gap.

3. An expansion joint sealing means as set forth in claim 1 wherein each of said marginal bodies includes an upstanding face portion laterally spaced from said gap and disposed generally parallel to the longitudinal edges thereof, each of said laterally spaced face portions being tapered toward said gap with each respective said slab member being formed against said laterally spaced face portion whereby the tapered interface between each said marginal body and respective said slab member prevents the former from lifting vertically upward at said interface.

4. An expansion joint sealing means as set forth in claim 1 wherein said anchor means engage each of the said marginal bodies in the central transverse portion thereof and the bottom surface of each said marginal body is of a concave configuration in transverse cross section in a disassembled form whereby the longitudinal edges of the bottom surface of said marginal body are drawn into firm engagement with said slab member upon assembly therewith.

5. An expansion joint sealing means as set forth in claim 1 wherein each said aperture tapers downwardly in the direction extending from said groove toward said gap so as to have a tapered interface with said longitudinal edge of said flexible sealing means whereby the engagements between said marginal body and said sealing means, and said sealing means and said structural slab member, become more firm as said sealing means expands.

6. An expansion joint sealing means as set forth in claim 3 wherein said anchor means engage each of the said marginal bodies in the central transverse portion thereof and the bottom surface of each said marginal body is of a concave configuration in transverse cross section in a disassembled form whereby the longitudinal edges of the bottom surface of said marginal body are drawn into firm engagement with said slab member upon assembly therewith.

7. An expansion joint sealing means as set forth in claim 3 wherein each said aperture tapers downwardly in the direction extending from said groove toward said gap so as to have a tapered interface with said longitudinal edge of said flexible sealing means whereby the engagements between said marginal body and said sealing means, and said sealing means and said structural slab member, become more firm as said sealing means expands.

8. An expansion joint sealing means as set forth in claim 3 wherein each of said marginal bodies includes an upstanding face portion disposed along a respectively adjacent longitudinal edge of said gap, said face portions being tapered away from said gap so that incompressible materials are forced out of said gap as said slab members expand towards one another to close said gap.

9. An expansion joint sealing means as set forth in claim 4 wherein each of said marginal bodies includes an upstanding face portion disposed along a respectively adjacent longitudinal edge of said gap, said face portions being tapered away from said gap so that incompressible materials are forced out of said gap as said slab members expand towards one another to close said gap.

10. An expansion joint sealing means as set forth in claim 4 wherein each said aperture tapers downwardly in the direction extending from said groove toward said gap so as to have a tapered interface with said longitudinal edge of said flexible sealing means whereby the engagements between said marginal body and said sealing means, and said sealing means and said structural slab member, become more firm as said sealing means expands.

11. An expansion joint sealing means as set forth in claim 5 wherein each of said marginal bodies includes an upstanding face portion disposed along a respectively adjacent longitudinal edge of said gap, said face portions being tapered away from said gap so that incompressible materials are forced out of said gap as said slab members expand towards one another to close said gap.

12. An expansion joint sealing means as set forth in claim 6 wherein each said aperture tapers downwardly in the direction extending from said groove toward said gap so as to have a tapered interface with said longitudinal edge of said flexible sealing means whereby the engagements between said marginal body and said sealing means, and said sealing means and said structural slab member, become more firm as said sealing means expands.

13. An expansion joint sealing means as set forth in claim 12 wherein each of said marginal bodies includes an upstanding face portion disposed along a respectively adjacent longitudinal edge of said gap, said face portions being tapered away from said gap so that incompressible materials are forced out of said gap as said slab members expand towards one another to close said gap.

* * * * *